US008529653B2

(12) United States Patent
Sakashita et al.

(10) Patent No.: US 8,529,653 B2
(45) Date of Patent: Sep. 10, 2013

(54) INDOOR UNIT OF AIR CONDITIONER

(75) Inventors: Akihiko Sakashita, Osaka (JP); Tsuyoshi Yokomizo, Osaka (JP); Morimichi Okada, Fukuoka (JP)

(73) Assignee: Daikin Industries, Ltd., Osaka (JP)

( * ) Notice: Subject to any disclaimer, the term of this patent is extended or adjusted under 35 U.S.C. 154(b) by 453 days.

(21) Appl. No.: 12/739,685

(22) PCT Filed: Sep. 30, 2008

(86) PCT No.: PCT/JP2008/002746

§ 371 (c)(1), (2), (4) Date: Apr. 23, 2010

(87) PCT Pub. No.: WO2009/054094

PCT Pub. Date: Apr. 30, 2009

(65) Prior Publication Data

US 2010/0258267 A1 Oct. 14, 2010

(30) Foreign Application Priority Data

Oct. 25, 2007 (JP) ..... 2007-277854
Jan. 25, 2008 (JP) ..... 2008-015629

(51) Int. Cl.
*B01D 46/38* (2006.01)

(52) U.S. Cl.
USPC ..... 55/295; 55/385.2; 55/428.1; 55/467.1; 55/471; 55/492

(58) Field of Classification Search
USPC ..... 62/303–316; 55/282–305, 428–433, 55/467–473, 385.1–385.8; 165/4–10, 95, 165/DIG. 85, 58–66, DIG. 10–DIG. 12, DIG. 76–DIG. 91
See application file for complete search history.

(56) References Cited

U.S. PATENT DOCUMENTS

| | | | | |
|---|---|---|---|---|
| 6,729,154 | B2 * | 5/2004 | Takashima et al. | 62/317 |
| 2004/0000160 | A1 * | 1/2004 | Takashima et al. | 62/317 |
| 2006/0070358 | A1 * | 4/2006 | Oda et al. | 55/295 |
| 2007/0060036 | A1 | 3/2007 | Shibuya et al. | |
| 2010/0287967 | A1 * | 11/2010 | Sakashita et al. | 62/303 |
| 2010/0287968 | A1 * | 11/2010 | Sakashita et al. | 62/303 |

FOREIGN PATENT DOCUMENTS

| | | | |
|---|---|---|---|
| JP | 2005-83721 | A | 3/2005 |
| JP | 2007-107762 | A | 4/2007 |
| JP | 2007-130628 | A | 5/2007 |
| JP | 2007-187437 | A | 7/2007 |

* cited by examiner

*Primary Examiner* — Duane Smith
*Assistant Examiner* — Thomas McKenzie
(74) *Attorney, Agent, or Firm* — Birch, Stewart, Kolasch & Birch, LLP.

(57) ABSTRACT

In an indoor unit of an air conditioner including an air filter arranged on a suction side of an indoor fan, dust trapped on the air filter is reliably and efficiently removed by a simple structure. For that purpose, an indoor unit (13) is provided with a dust remover (50) for removing dust trapped on an air filter (40) arranged on a suction side of an indoor fan (39), and a filter presser (70) for pressing a frame (42) of the air filter (40) so as to press the air filter (40) against the dust remover (50). The air filter (40) is configured to move relative to the dust remover (50), and the filter presser (70).

6 Claims, 10 Drawing Sheets

INDOOR UNIT OF AIR CONDITIONER

TECHNICAL FIELD

The present invention relates to indoor units of air conditioners configured to remove dust trapped on an air filter.

BACKGROUND ART

Among indoor units of air conditioners having an air filter at an air inlet, those provided with a dust remover for removing dust trapped on the air filter have been known. As taught by Patent Document 1, for example, in an indoor unit of this type, a cleaning brush as the dust remover moves in good contact with the air filter. Specifically, for reliably pressing the cleaning brush against a filter portion of the air filter, a frame of the air filter includes a rib, and an outer frame both extending in the direction of movement of the cleaning brush, and the cleaning brush is arranged between the rib and the outer frame of the air filter.

More specifically, as schematically shown in FIGS. 10 and 11, a filter presser (170) for pressing the filter portion (141) against the cleaning brush (151) is provided for reliable and efficient removal of the dust trapped on a filter portion (141) of an air filter (140) by a cleaning brush (151). The filter presser (170) includes a support plate (171) extending in a lateral direction of the air filter (140), and a pressing portion (172) arranged below the support plate (171). The air filter (140) includes longitudinal ribs (142) only which extend in the direction of movement of the filter presser (170) so as not to inhibit contact between the pressing portion (172) of the filter presser (170) and the filter portion (141).

The dust removed from the air filter by the dust remover, such as the cleaning brush, is contained in a dust storage as taught by Patent Document 2, for example.

Patent Document 3 describes a mechanism for pressing a round rotatable air filter against a rotating brush including a net presser facing the rotating brush with the air filter interposed therebetween. The net presser rotates away from a radial rib of the air filter when the net presser abuts the radial rib. After the radial rib has passed through, the net presser returns to the original position by a biasing force of a spring to press the air filter against the rotating brush.

PATENT DOCUMENTS

[Patent Document 1] Japanese Patent Publication No. 2007-107762

[Patent Document 2] Japanese Patent Publication No. 2005-83721

[Patent Document 3] Japanese Patent Publication No. 2007-130628

SUMMARY OF THE INVENTION

Technical Problem

In the air conditioner of Patent Document 1 described above, the ribs which are part of the frame of the air filter extend in the direction of movement of the cleaning brush in such a manner that the filter portion of the air filter is reliably pressed against the cleaning brush. Accordingly, the ribs can increase rigidity of the air filter in the direction of movement of the cleaning brush, but the ribs cannot increase rigidity of the air filter in the direction orthogonal to the moving direction of the cleaning brush of the air filter. Thus, the rigidity of the whole air filter is not very high. When the cleaning brush is pressed against the filter portion, the filter portion may bend, or may become wrinkled. Therefore, the dust trapped on the filter portion cannot reliably and efficiently be removed by the cleaning brush.

As a possible solution to this, as taught by Patent Document 3, ribs can be arranged to extend in two directions for high rigidity, and a filter presser for pressing the air filter against the brush may be configured to move away from the ribs so as not to interfere with the ribs. However, this mechanism is complicated, thereby increasing costs of the whole structure.

In view of the foregoing, the present invention has been achieved. An object of the invention is to provide an indoor unit of an air conditioner having an air filter on a suction side of an indoor fan, in which dust trapped on the air filter can reliably and efficiently be removed by a simple structure.

Solution to the Problem

For the above-described object, in an indoor unit (13) of an air conditioner (10) of the present invention, a filter presser (70) is provided which presses a frame (42) of an air filter (40) so as to press the air filter (40) against a dust remover (50). This makes it possible to provide ribs (44, 45) of the frame (42) with a shape which can increase the rigidity of the whole air filter (40), and to prevent interference between the ribs (44, 45) and the filter presser (70).

Specifically, a first aspect of the invention is directed to an indoor unit of an air conditioner including: a casing (34) containing an indoor heat exchanger (37), an indoor fan (39) for sucking air from the inside of a room, and blowing the air to the inside of the room, and an air filter (40) arranged on a suction side of the indoor fan (39).

The indoor unit includes: a dust remover (50) for removing dust trapped on the air filter (40); and a filter presser (70) which presses a frame (42) of the air filter (40) so as to press the air filter (40) against the dust remover (50), wherein the air filter (40) is configured to move relative to the dust remover (50), and the filter presser (70).

With this configuration, the filter presser (70) presses the frame (42) of the air filter (40) to press the filter portion (41) against the dust remover (50). This allows for efficient removal of the dust trapped on the filter portion (41) by the dust remover (50). With the above-described configuration, the shape of the frame (42) is not limited unlike the conventional structure in which the filter portion (41) is directly pressed against the dust remover (50). Therefore, the frame can be provided with a shape which can increase the rigidity of the whole air filter (40). Specifically, ribs (44, 45) which are part of the frame (42) may include not only a first rib (44) extending in the direction of movement of the air filter (40) and the dust remover (50), but also a second rib (45) extending in the direction orthogonal to the moving direction.

Since the filter presser (70) presses the frame (42) as described above, unlike the conventional structure in which the filter presser (70) directly presses the filter portion (41) against the dust remover (50), the interference between the filter presser (70) and the frame (42) can reliably be prevented.

In the above-described configuration, the frame (42) of the air filter (40) preferably includes an outer frame (43), and a first rib (44) arranged inside the outer frame (43) to extend in the direction of movement of the air filter (40) and the dust remover (50), and the filter presser (70) is preferably configured to abut the first rib (44) to press the air filter (40) against the dust remover (50) (a second aspect of the invention).

In this way, the filter portion (41) of the air filter (40) can reliably be pressed against the dust remover (50) by abutting the filter presser (70) to the first rib (44) of the frame (42) of the air filter (40), as compared with the case where the filter presser abuts the outer frame (43) only. This allows for reliable and efficient removal of the dust trapped on the filter portion (41) by the dust remover (50).

The frame (42) of the air filter (40) preferably further includes a second rib (45) intersecting with the first rib (44) (a third aspect of the invention). The provision of the second rib (45) intersecting with the first rib (44) can increase the rigidity of the whole air filter (40). Thus, the filter portion (41) can reliably be pressed against the dust remover (50) by pressing the rib (44) etc., without directly pressing the filter portion (41) of the air filter (40) against the dust remover (50). This allows for reliable and efficient removal of the dust trapped on the air filter (40) by the dust remover (50).

A height of the second rib (45) protruding toward the filter presser (70) is preferably the same as or smaller than a height of the first rib (44) (a fourth aspect of the invention). Thus, the interference of the filter presser (70) with the second rib (45) can reliably be prevented even if the filter presser (70) relatively moves while abutting the first rib (44).

The filter presser (70) includes a plate-like pressing portion (72) which is bent at one end near the air filter (40), and abuts the frame (42) of the air filter (40) at the bent end (a fifth aspect of the invention). Thus, the one end of the plate-like pressing portion (72) is kept in contact with the frame (42) of the air filter (40), thereby keeping the air filter (40) pressed against the dust remover (50). This allows for reliable and efficient removal of the dust trapped on the air filter (40) by the dust remover (50).

A guard member (110) is preferably provided above the pressing portion (122) to cover the pressing portion (122) (a sixth aspect of the invention). With this configuration, the pressing portion (122) will not be touched by mistake by an operator during maintenance etc., thereby preventing deformation of the pressing portion (122). Specifically, when the pressing portion (122) is a plate member, and the operator touches the pressing portion (122), the pressing portion (122) may be deformed, thereby impairing the function of pressing the air filter (40). However, with the guard member (110) provided above the pressing portion, the deformation of the pressing portion (122) due to contact from above can reliably be prevented.

The filter presser (75) may include a plate member (76) arranged to laterally extend across the air filter (40), and the plate member (76) may be biased in such a manner that one of long sides thereof is pressed against the frame (42) of the air filter (40) (a seventh aspect of the invention).

With this configuration, the filter presser (75) for pressing the frame (42) of the air filter (40) may be comprised of the plate member (76). Therefore, as compared with the case where the pressing portions (72) are provided for the ribs (44) of the frame (42), respectively, the parts count can be reduced. This allows for easy assembly, thereby reducing costs.

The air filter (80) is preferably substantially round when viewed in plan, and an outer frame (83) and a rib (84) of a frame (82) of the air filter (80) are also preferably substantially round when viewed in plan, and the air filter (80) is preferably configured to rotate relative to the dust remover (95), and the filter presser (100) (an eighth aspect of the invention).

Even when the round air filter (80) includes the round outer frame and the round rib (84) when viewed in plan, and the air filter (80) is configured to rotate relative to the dust remover (95), and the filter presser (100), the same advantages as those of the first to seventh aspects of the invention can be obtained by applying the configuration of the first to seventh aspect of the invention. Thus, the filter presser (100) presses the air filter (80) against the dust remover (95), thereby allowing for reliable and efficient removal of the dust trapped on the air filter (80) by the dust remover (95).

ADVANTAGES OF THE INVENTION

According to the present invention described above, in the indoor unit (13) of the air conditioner (10), the filter presser (70) for pressing the frame (42) of the air filter (40) is provided so as to press the air filter (40) against the dust remover (50) for removing the dust trapped on the air filter (40), and the air filter (40) is configured to move relative to the dust remover (50), and the filter presser (70). Thus, the dust trapped on the air filter (40) can efficiently be removed by the dust remover (50) while pressing the air filter (40) against the dust remover (50). Since the filter presser (70) presses the frame (42) of the air filter (40), the frame (42) can be provided with a shape which can increase the rigidity of the whole air filter (40). Further, unlike the conventional structure, there is no need to provide a structure for preventing the interference of the filter presser (70) with the frame (42). This allows for reliable and efficient removal of the dust trapped on the air filter (40) by a simple structure.

According to the second aspect of the invention, the filter presser (70) abuts the first rib (44) of the frame (42) of the air filter (40) to press the air filter (40) against the dust remover (50). Therefore, as compared with the case where only the outer frame is pressed, the air filter (40) can reliably be pressed against the dust remover (50), thereby reliably and efficiently removing the dust trapped on the air filter (40).

According to the third aspect of the invention, the frame (42) of the air filter (40) includes the second rib (45) intersecting with the first rib (44). This increases the rigidity of the whole air filter (40). Thus, as described above, the whole air filter (40) can reliably be pressed against the dust remover (50) by pressing the first rib (44) of the frame (42) by the filter presser (70). This allows for reliable and efficient removal of the dust trapped on the air filter (40) by the dust remover (50).

According to the fourth aspect of the invention, the height of the second rib (45) protruding toward the filter presser (70) is the same as or smaller than the height of the first rib (44). Therefore, when the filter presser (70) relatively moves while abutting the first rib (44), the interference of the filter presser (70) with the second rib (45) can reliably be prevented. This allows for smooth relative movement of the filter presser (70) and the air filter (40).

According to the fifth aspect of the invention, the filter presser (70) includes the plate-like pressing portion (72) which is bent at one end, and abuts the frame (42) of the air filter (40) at the bent end. Thus, the frame (42) of the air filter (40) is always kept pressed against the dust remover (50) by the one end. This allows for reliable and efficient removal of the dust trapped on the air filter (40) by the dust remover (50).

According to the sixth aspect of the invention, the guard member (110) is provided above the pressing portion (122). This can prevent deformation of the pressing portion (122), and can reliably press the air filter (40) against the dust remover (50).

According to the seventh aspect of the invention, the filter presser (75) includes the plate member (76) arranged to laterally extend across the air filter (40). This can reduce the parts count, thereby reducing costs.

According to the eighth aspect of the invention, the air filter (80), the outer frame (83), and the rib (84) are substantially round when viewed in plan, and the air filter (80) is configured to rotate relative to the dust remover (95), and the filter presser (100). Even with this configuration, the same advantages as those of the first to seventh aspects of the invention can be obtained by applying the configuration of the first to seventh aspects of the invention. Thus, even in the above-described configuration, the air filter (80) is pressed against the dust remover (95), thereby allowing for reliable and efficient removal of the dust trapped on the air filter (80) by the dust remover (95).

DESCRIPTION OF EMBODIMENTS

Embodiments of the present invention will be described in detail below with reference to the drawings. The following preferable embodiments will be set forth merely for the purposes of preferred examples in nature, and are not intended to limit the scope, applications, and use of the invention.

First Embodiment

The present embodiment is directed to an air conditioner (10) including an indoor unit (13) of the present invention. In the air conditioner (10), the indoor unit (13) is arranged on a ceiling of a room. In the following description, the structure of the air conditioner (10) of the present embodiment will be described first, and then the structure of the indoor unit (13) will be described.

<General Structure>

Figure 1:
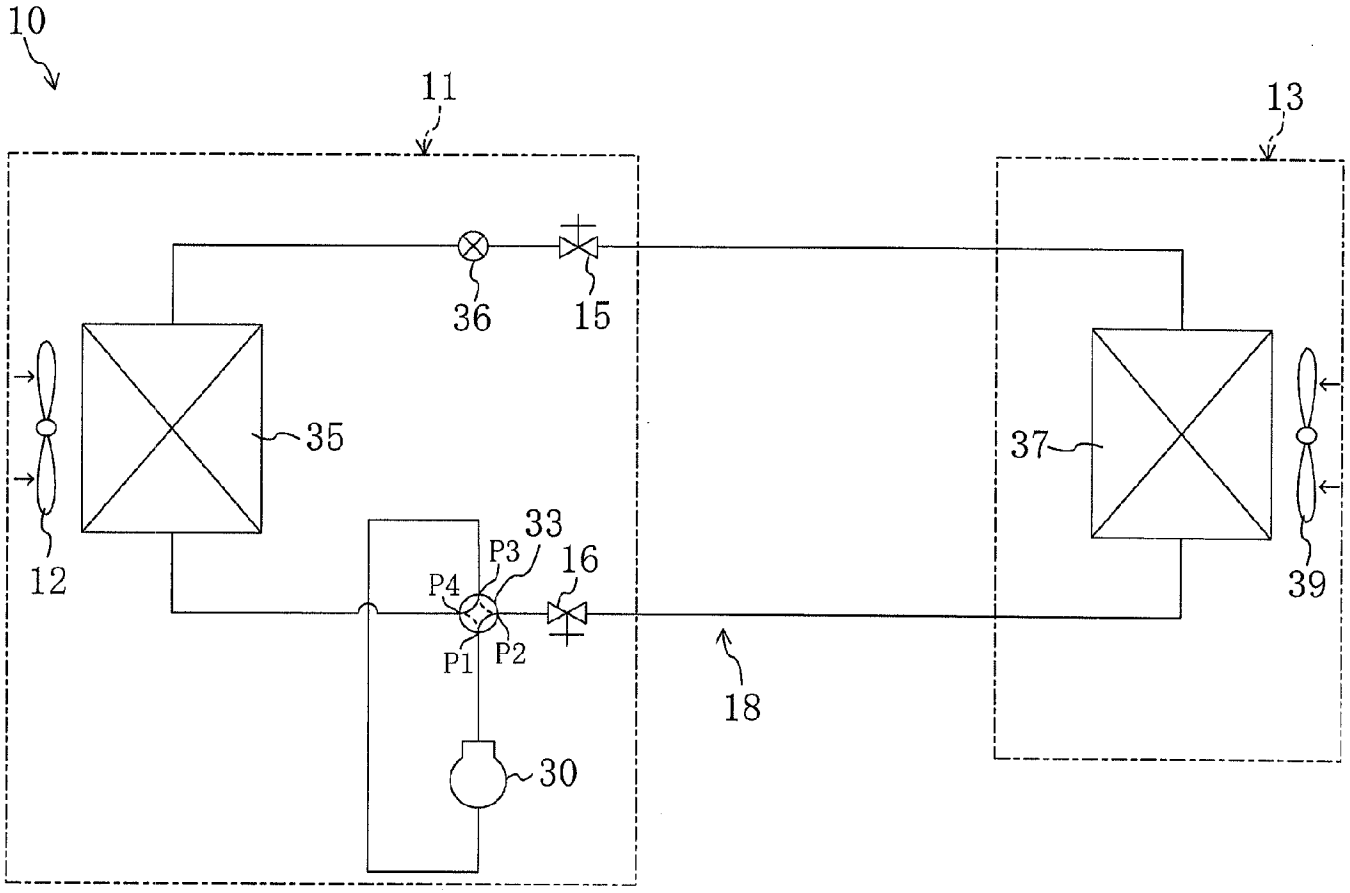
FIG. 1 is a piping diagram illustrating the structure of an air conditioner including an indoor unit according to an embodiment of the present invention.

As shown in FIG. 1, the air conditioner (10) includes an outdoor unit (11), and an indoor unit (13). The outdoor unit (11) includes a compressor (30), an outdoor heat exchanger (35), an expansion valve (36), a four way switching valve (33), and an outdoor fan. The indoor unit (13) includes an indoor heat exchanger (37) and an indoor fan (39).

In the outdoor unit (11), a discharge side of the compressor (30) is connected to a first port (P1) of the four way switching valve (33). A suction side of the compressor (30) is connected to a third port (P3) of the four-way switching valve (33).

The outdoor heat exchanger (35) is configured as a cross-fin type fin-and-tube heat exchanger. One end of the outdoor heat exchanger (35) is connected to a fourth port (P4) of the four-way switching valve (33). The other end of the outdoor heat exchanger (35) is connected to a liquid stop valve (15).

The outdoor fan (12) is arranged near the outdoor heat exchanger (35). In the outdoor heat exchanger (35), outdoor air sent by the outdoor fan (12) and a refrigerant circulating in the outdoor heat exchanger (35) exchange heat. An expansion valve (36) capable of changing the degree of opening is provided between the outdoor heat exchanger (35) and the liquid stop valve (15). A second port (P2) of the four-way switching valve (33) is connected to a gas stop valve (16).

The four-way switching valve (33) is configured to be able to switch between a first state where the first port (P1) and the second port (P2) communicate with each other, and the third port (P3) and the fourth port (P4) communicate with each other (a state indicated by a solid line in FIG. 1), and a second state where the first port (P1) and the fourth port (P4) communicate with each other, and the second port (P2) and the third port (P3) communicate with each other (a state indicated by a broken line in FIG. 1).

In this air conditioner (10), heating operation is performed when the four-way switching valve (33) is set to the first state, and cooling operation is performed when the four-way switching valve (33) is set to the second state. In the heating operation, a vapor compression refrigeration cycle is performed in which the outdoor heat exchanger (35) and the indoor heat exchanger (37) in a refrigerant circuit (18) function as an evaporator and a condenser, respectively. In the cooling operation, a vapor compression refrigeration cycle is performed in which the outdoor heat exchanger (35) and the indoor heat exchanger (37) in the refrigerant circuit (18) function as a condenser and an evaporator, respectively.

<Structure of Indoor Unit>

The structure of the indoor unit (13) will be described in detail below with reference to FIGS. 2 to 5.

Figure 2:
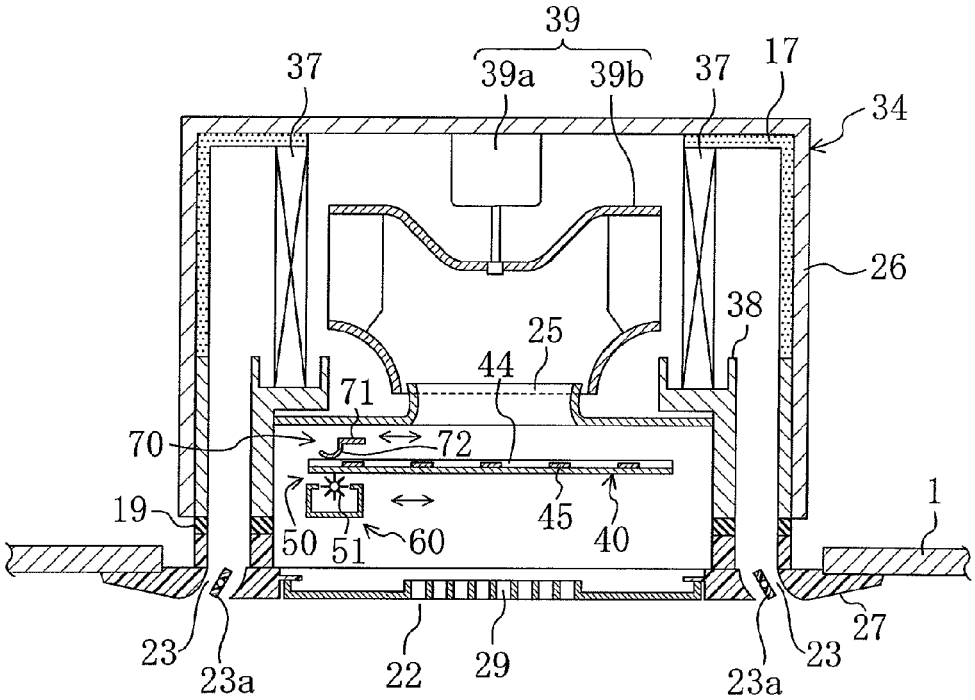
FIG. 2 is a vertical cross-sectional view illustrating the inside of a casing.

As shown in FIG. 2, the indoor unit (13) includes an indoor casing (34) including a casing body (26), and a decorative panel (27). The indoor casing (34) contains the indoor heat exchanger (37), a drain pan (38), the indoor fan (39), the air filter (40), a dust remover (50), a dust container (60), and a filter presser (70).

The casing body (26) is in the shape of a substantially rectangular parallelepiped box having an open bottom. A heat insulator (17) is laminated on an inner surface of the casing body (26). The casing body (26) is suspended from an upper board in space above a ceiling with its lower portion fitted in an opening (1*a*) in a ceiling board (1).

Figure 3:
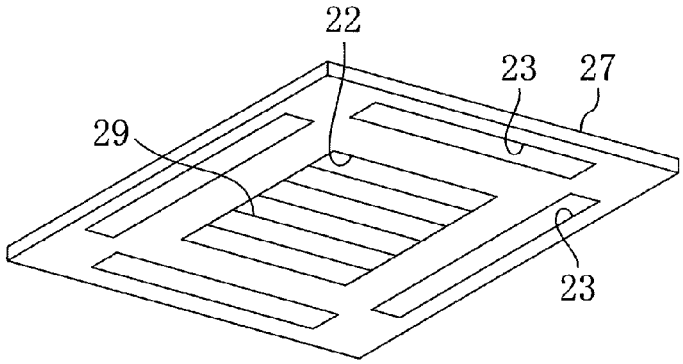
FIG. 3 is a perspective view of the indoor unit as viewed from the inside of a room.

The decorative panel (27) is in the shape of a rectangular plate (see FIG. 3). When viewed in plan, the decorative panel (27) is slightly larger than the casing body (26). The decorative panel (27) is attached to the casing body (26) to cover a lower portion of the casing body (26) with a sealing member (19) sandwiched therebetween. The decorative panel (27), when attached to the casing body (26), is exposed in the room.

As shown in FIG. 3, the decorative panel (27) is provided with one inlet (22) and four outlets (23). The inlet (22) is rectangular-shaped, and is formed in the center of the decorative panel (27). A suction grille (29) (a grille portion) provided with slits is fitted in the inlet (22). Each of the outlets (23) is in the shape of a narrow rectangle, and they are formed along the sides of the decorative panel (27), respectively. An adjuster plate (23*a*) for adjusting the direction of air flow is provided at each of the outlets (23) (see FIG. 2 etc.). The adjuster plate (23*a*) rotates to adjust the direction of air flow (the direction of blowing air).

The indoor fan (39) is a so-called turbo fan. As shown in FIG. 2, the indoor fan (39) is arranged near the center of the casing body (26) and above the inlet (22). The indoor fan (39) includes a fan motor (39*a*) and an impeller (39*b*). The fan motor (39*a*) is fixed to a top plate of the casing body (26). The impeller (39*b*) is connected to a rotation shaft of the fan motor (39*a*). A bell mouth (25) communicating with the inlet (22) is provided below the indoor fan (39). The bell mouth (25) divides space in the casing (34) upstream of the indoor heat exchanger (37) into a room near the indoor fan (39) and a room near the suction grille (29). The indoor fan (39) is configured to blow air sucked from below through the bell mouth (25) in a radial direction.

The indoor heat exchanger (37) is configured as a cross-fin type fin-and-tube heat exchanger. When viewed in plan, the indoor heat exchanger (37) is in the shape of a rectangular frame, and is arranged to surround the indoor fan (39). In the indoor heat exchanger (37), indoor air (blowing air) sent by the indoor fan (39) and a refrigerant circulating in the indoor heat exchanger (37) exchange heat.

The drain pan (38) is arranged below the indoor heat exchanger (37). The drain pan (38) receives drainage generated because of condensation of moisture in the air in the indoor heat exchanger (37). The drain pan (38) is provided with a drain pump (not shown) for discharging the drainage. The drain pan (38) is inclined so that the drainage is collected to part of the drain pan at which the drain pump is provided.

The air filter (40) is substantially in the shape of a rectangular sheet when viewed in plan as described later, and is arranged below the bell mouth (25) (near an inlet of the bell mouth). The air filter (40) is detachably arranged in the casing (34).

Figure 4:
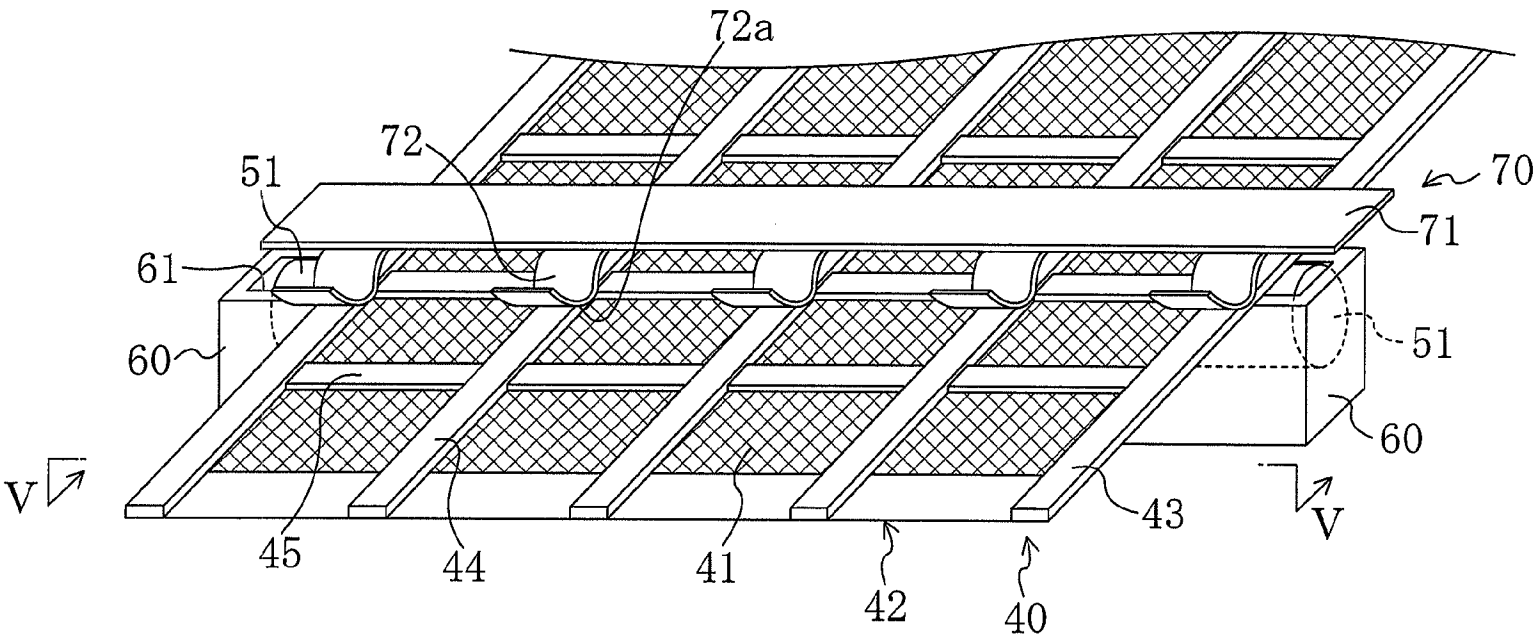
FIG. 4 is a perspective view schematically illustrating the neighborhood of an air filter of a first embodiment.
Figure 5:
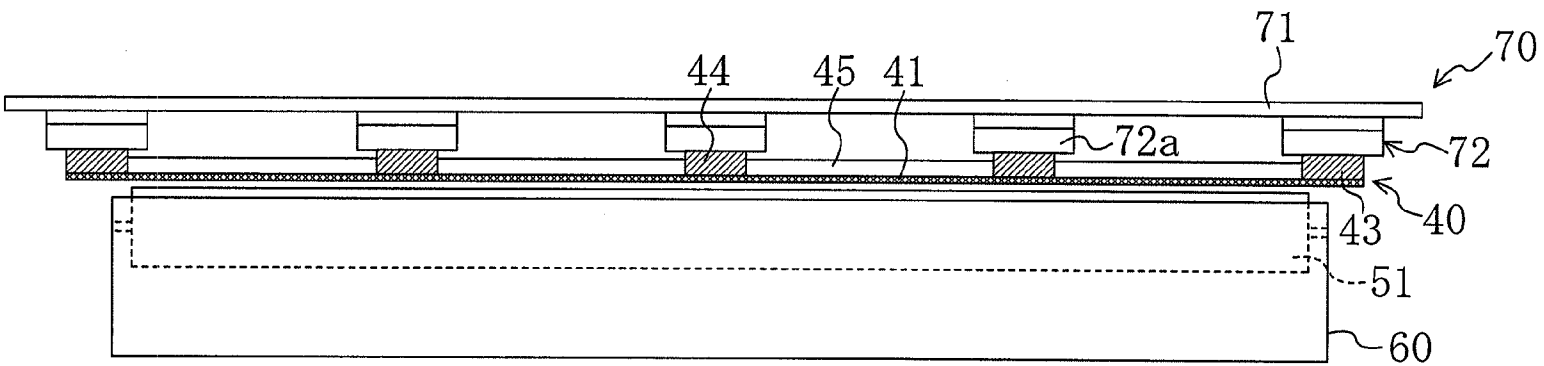
FIG. 5 is a cross-sectional view taken along the line V-V in FIG. 4.

The dust remover (50) is provided for removing the dust trapped on the air filter (40). The dust remover (50) includes a rotating brush (51) as a brush member as shown in FIGS. 2, 4, and 5.

The rotating brush (51) includes a rod-like shaft portion, and a bristle portion including a plurality of bristles attached to a circumferential surface of the shaft portion. The rotating brush (51) is arranged in a brush receiving opening (61) of a dust container (60) described later, and is positioned below the air filter (40). The rotating brush (51) is configured to remove the dust as it moves relative to the air filter (40) together with the dust container (60), and comes into contact with the moving filter body (41).

As described in detail later, the air filter (40) is configured in such a manner that a lower surface thereof (a surface facing the inside of the room) is pressed against the rotating brush (51) by a filter presser (70) arranged above the air filter (40). Thus, the dust trapped on the air filter (40) can reliably and efficiently be removed by a bristle portion of the rotating brush (51).

The dust container (60) is provided to temporarily contain the dust removed from the air filter (40) by the rotating brush (51). The dust container (60) is a slightly narrow, rectangular parallelepiped-shaped container, and is arranged below the air filter (40) to extend laterally across the air filter (40) (see FIG. 2 etc.). A brush receiving opening (61) extending in the longitudinal direction of the dust container (60) is formed in an upper surface of the dust container (60). As described above, the rotating brush (51) is rotatably arranged in the brush receiving opening (61). As shown in FIGS. 2, 4, and 5, the rotating brush (51) is arranged in the brush receiving opening (61) with part of the bristle portion protruding outside the container.

The indoor unit (13) includes an unshown movement mechanism for moving the dust container (60) and the filter presser (70) in the horizontal direction (in the right-left direction in FIG. 2). The movement mechanism includes a belt running over two pulleys coupled to a motor, for example, and projections are integrally formed on an outer circumferential surface of the belt to engage with and transfer the dust container (60) and the filter presser (70). In the present embodiment, the dust container (60) and the filter presser (70) are moved relative to the air filter (40). However, the movement is not limited thereto, and the air filter (40) may be moved relative to the dust container (60) and the filter presser (70).

—Structures of Air Filter and Filter Presser—

As described above, the air filter (40) is in the shape of substantially rectangular sheet when viewed in plan, and includes a filter portion (41) for trapping the dust, and a frame (42) for holding the filter portion (41). The frame (42) is arranged on the periphery of the filter portion (41), and includes an outer frame (43) as an outer peripheral portion of the air filter (40), and longitudinal ribs (44) (first ribs) arranged inside the outer frame (43) to extend in the direction of movement of the dust container (60) and the filter presser (70), and lateral ribs (45) (second ribs) extending orthogonal to the longitudinal ribs (44). In the present embodiment, longitudinal portions of the outer frame (43) have substantially the same shape as the longitudinal ribs (44).

Figure 10:
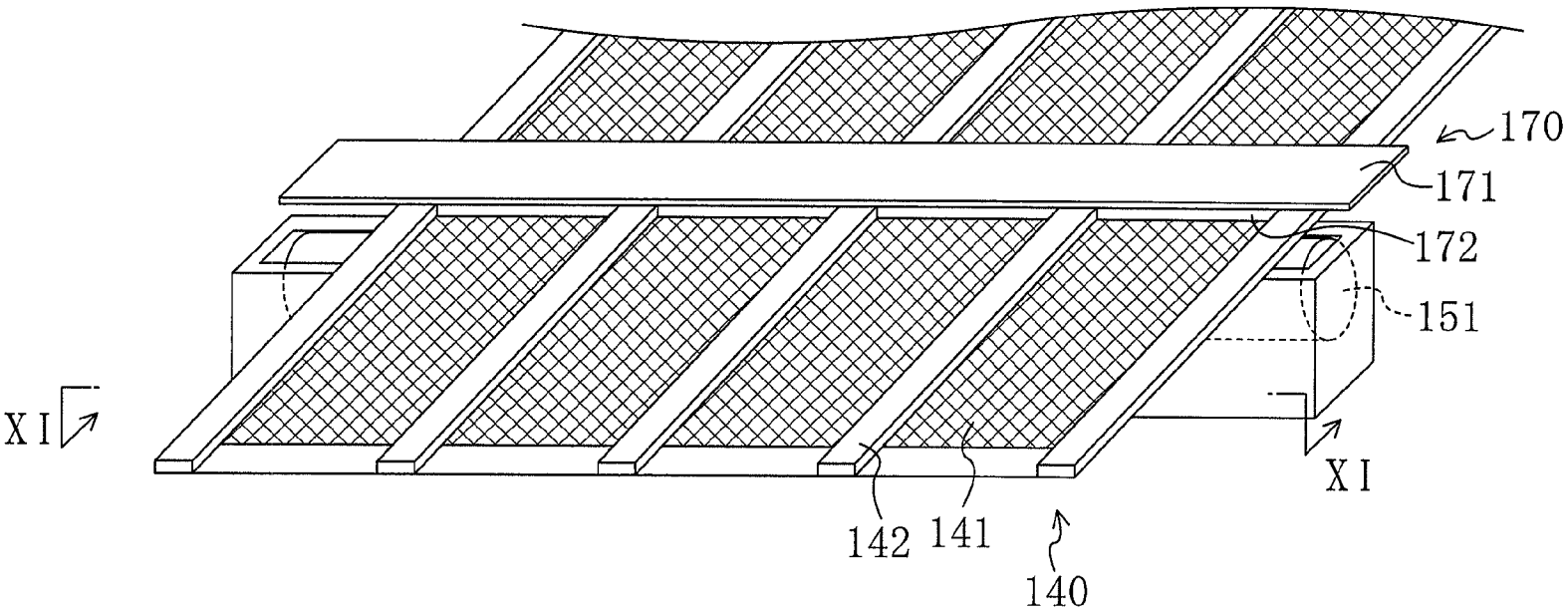
FIG. 10 is a perspective view schematically illustrating the neighborhood of a conventional air filter.
Figure 11:
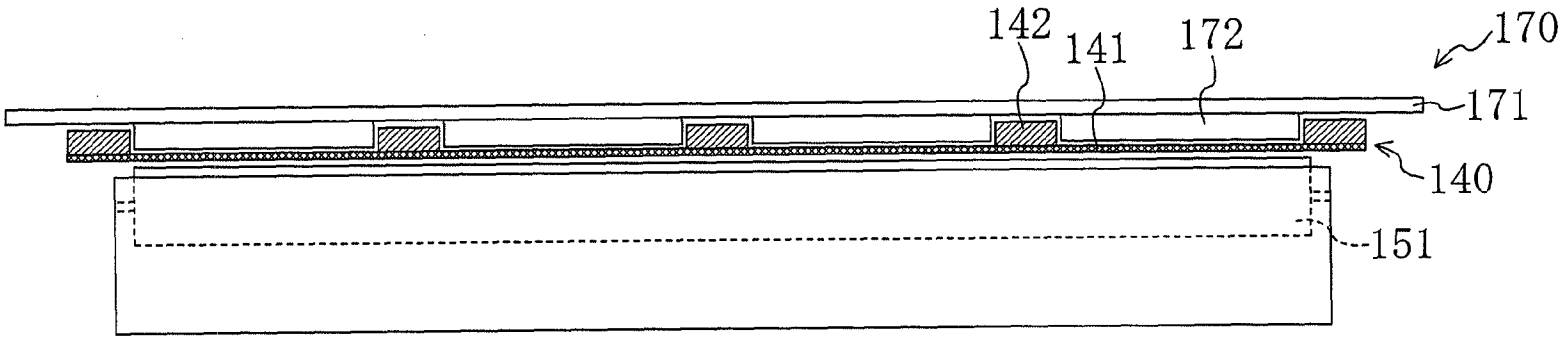
FIG. 11 is a cross-sectional view taken along the line XI-XI in FIG. 10.

The provision of the longitudinal ribs (44) and the lateral ribs (45) as part of the frame (42) of the air filter (40) can increase the rigidity of the whole air filter (40) as compared with the structure where only the longitudinal ribs are provided (see FIG. 10). Specifically, in the case where only the longitudinal ribs are provided as the frame of the air filter, the rigidity may be increased in the extending direction of the longitudinal ribs, but the rigidity cannot be increased in the direction orthogonal to the extending direction of the longitudinal ribs. Therefore, the rigidity of the whole air filter cannot be increased very much. However, additional provision of the lateral ribs (45) as described above makes it possible to increase the rigidity not only in the extending direction of the longitudinal ribs (44), but also in the direction orthogonal to the extending direction. This can increase the rigidity of the whole air filter (40).

Thus, even when the longitudinal ribs (44) are pressed by the filter presser (70) as described later, the filter portion (41) can reliably be pressed against the rotating brush (51) due to the rigidity of the whole air filter (40). This allows for reliable and efficient removal of the dust trapped on the filter portion (41) by the rotating brush (51).

Each of the longitudinal ribs (44) of the air filter (40) has a width which allows a pressing portion (72) of the filter presser (70) described later to come into contact with the longitudinal rib, and protrudes toward the filter presser (70) to have a height same as or larger than the height of the lateral ribs (45). Therefore, when the filter presser (70) moves while abutting the longitudinal ribs (44), interference of the pressing portion (72) of the filter presser (70) with the lateral ribs (45) can reliably be prevented.

The filter presser (70) includes a support plate (71) which extends in the lateral direction of the air filter (40), and has a lateral dimension larger than that of the air filter (40), and a plurality of pressing portions (72, 72, . . . ) supported by the support plate (71). As shown in FIG. 4, each of the pressing portions (72) is a flat plate member, and is bent into a downward convex shape at one end thereof to have a substantially semicircular cross section. The pressing portions (72) are fixed to the support plate (71) to correspond to the longitudinal ribs (44) and the longitudinal portions of the outer frame (43) in such a manner that the bent ends thereof are in contact with upper surfaces of the longitudinal ribs (44) and the longitudinal portions of the outer frame (43) of the air filter (40). Specifically, the pressing portions (72) are fixed to the support plate (71) at the other ends, and are in contact with the longitudinal ribs (44) and the longitudinal portions of the outer frame (43) of the air filter (42) at the bent portions (72*a*) at the one ends which are bent to have a substantially semi-circular cross section. With the other ends of the pressing portions (72) fixed to the support plate (71), and the one ends of the pressing portions (72), which are free ends, bent into a downward convex shape as described above, the one ends are reliably brought into contact with the longitudinal ribs (44) and the longitudinal portions of the outer frame (43), thereby reliably biasing the longitudinal ribs (44) and the longitudinal portions of the outer frame (43) downward.

The filter presser (70) is connected to the dust container (60) through an unshown connector, and is configured to move in the longitudinal direction of the air filter (40) together with the dust container (60) with the air filter (40) interposed between the filter presser (70) and the dust container (60).

With the above-described configuration, the air filter (40) can be moved relative to the rotating brush (51) arranged in the brush receiving opening (61) of the dust container (60), while being pressed against the rotating brush (51). Thus, the dust trapped on the air filter (40) can reliably and efficiently be removed by the rotating brush (51).

<Filter Cleaning Operation>

The air conditioner (10) of the present embodiment is capable of switchably performing normal operation of cooling/heating the room, and filter cleaning operation of cleaning the air filter (40).

First, in the normal operation, the compressor (30), the outdoor fan (12), and the indoor fan (39) are driven. Indoor air is sucked into the indoor unit (13) through the inlet (22), passes through the bell mouth (25), and blows out of the indoor fan (39). The air blowing from the indoor fan is cooled or heated due to heat exchange with a refrigerant in the indoor heat exchanger (37), and is supplied to the inside of the room through the outlets (23).

As shown in FIG. 2, the air filter (40) is arranged to cover the bell mouth (25). Therefore, the indoor air sucked through the inlet (22) passes through the air filter (40) before entering the bell mouth (25). As the air passes through the air filter, the dust is trapped on the air filter (40).

The filter cleaning operation (filter cleaning) will be described below with reference to FIGS. 2, 4, and 5. In the filter cleaning operation, filter dust removal operation of removing the dust trapped on the air filter (40) is performed.

First, in the filter cleaning operation, the indoor fan (39) is stopped. Then, as the filter dust removal operation, a movement mechanism (not shown) for moving the dust container (60) and the filter presser (70) is driven, and the dust container (60) and the filter presser (70) move in the longitudinal direction of the air filter (40) (to the right in FIG. 2) with the air filter (40) interposed therebetween.

In this case, the filter presser (70) moves with the pressing portions (72) kept in contact with the upper surfaces of the longitudinal ribs (44) and the longitudinal portions of the outer frame (43) of the air filter (40). Thus, the filter presser (70) moves while pressing the air filter (40) against the rotating brush (51) below the air filter (40) by the pressing portions (72). Then, the rotating brush (51) can reliably come into contact with the surface of the air filter (40) facing the inside of the room. This allows for reliable and efficient removal of the dust trapped on the air filter (40) by the rotating brush (51). The dust removed by the rotating brush (51) is contained in the dust container (60).

The dust contained in the dust container (60) can easily be collected by opening the suction grille (29), and detaching the dust container (60) from the casing (34).

Advantages of First Embodiment

According to the present embodiment, the dust remover (50) for removing the dust trapped on the air filter (40) arranged on the suction side of the indoor fan (39) is provided in the indoor unit (13). Further, the filter presser (70) is provided which presses the longitudinal ribs (44) of the frame (42) and the longitudinal portions of the outer frame (43) of the air filter (40) downward, thereby pressing the filter portion (41) against the rotating brush (51) of the dust remover (50). This allows for efficient removal of the dust trapped on the air filter (40) by the rotating brush (51). Since the filter presser (70) presses the longitudinal ribs (44) of the air filter (40) and the longitudinal portions of the outer frame (43) downward to press the filter portion (41) against the rotating brush (51), the lateral ribs (45) can be provided without imposing limitations to the structure of the ribs, and making the structure of the filter presser (70) complicated, unlike the conventional structure where the filter portion (41) is directly pressed against the rotating brush (51). This can increase the rigidity of the whole air filter (40), thereby allowing for further reliable pressing of the air filter (40) against the rotating brush (51) by the filter presser (70).

As described above, the filter presser (70) is provided to press the longitudinal ribs (44) of the air filter (40) downward by the pressing portions (72). Therefore, every part of the filter portion (41) of the air filter (40) can more reliably be pressed against the rotating brush (51), thereby allowing for more efficient removal of the dust trapped on the filter portion (41) by the rotating brush (51).

In the air filter (40), the height of the lateral ribs (45) protruding toward the filter presser (70) is the same as or smaller than the height of the longitudinal ribs (44). Therefore, even if the filter presser (70) relatively moves with the pressing portions (72) of the filter presser (70) kept in contact with the longitudinal ribs (44), the interference of the pressing portions (72) with the lateral ribs (45) can reliably be prevented by a simple structure.

Each of the pressing portions (72) is bent into a downward convex shape at one end thereof to have a substantially semi-circular cross section, and is provided on the support plate (71) in such a manner that the bent portions (72*a*) are in contact with the longitudinal ribs (44) and the longitudinal portions of the outer frame (43) of the air filter (40). Thus, the longitudinal ribs (44) and the longitudinal portions of the outer frame (43) can more reliably be biased downward by the pressing portions (72), and the filter portion (41) of the air filter (40) can more reliably be pressed against the rotating brush (51). This allows for more reliable and efficient removal of the dust trapped on the filter portion (41) by the rotating brush (51).

Alternative Example of First Embodiment

Figure 6:
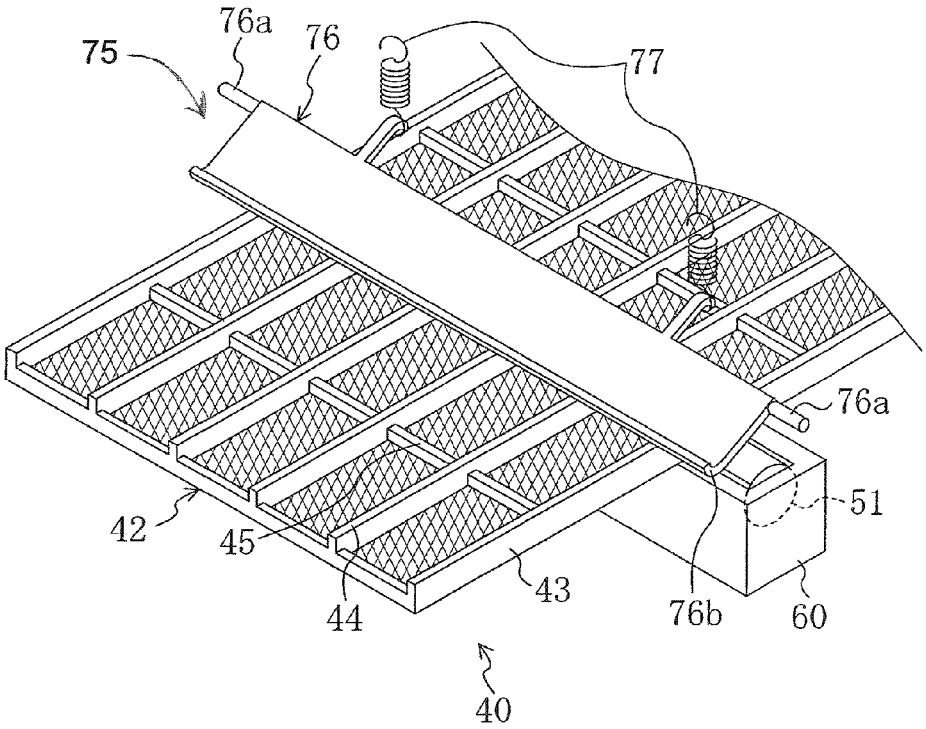
FIG. 6 is a perspective view schematically illustrating the neighborhood of an alternative example of the air filter.

FIG. 6 shows an alternative example of the first embodiment. In the alternative example, the filter presser is configured in a different manner from the first embodiment.

Specifically, in this alternative example, a filter presser (75) is constituted of a substantially rectangular plate member (76) which has a lateral dimension larger than that of the air filter (40), and is arranged to extend laterally across the air filter (40). That is, the plate member (76) is in contact with the longitudinal ribs (44) of the air filter (40) at one of the long sides thereof, and is supported by the indoor unit (13) at the other long side through springs (77, 77). On the longitudinal ends of the plate member (76), protrusions (76*a*, 76*a*) protruding in the longitudinal direction of the plate member (76) are arranged near the other long side of the plate member (76), respectively, and the protrusions (76*a*, 76*a*) are rotatably supported by the indoor unit (13).

The one of the long sides of the plate member (76) in contact with the longitudinal ribs (44) of the air filter (40) has a bent portion (76*b*) which is bent in the thickness direction and extends in the longitudinal direction of the plate member (76). The bent portion (76*b*) is substantially arc-shaped when viewed in lateral section, and an outer circumference of the substantially arc-shaped bent portion (76*b*) is in contact with the longitudinal ribs (44).

With this configuration, the other long side of the plate member (76) is pulled upward due to elastic resilience of the springs (77, 77), thereby pressing the one long side of the plate member (76) against the longitudinal ribs (44) of the air filter (40). Thus, the above-described configuration makes it possible to reliably bias the longitudinal ribs (44) of the air filter (40) downward, thereby pressing the air filter (40) against the rotating brush (51). This allows for reliable removal of the dust trapped on the lower surface (the surface facing the inside of the room) of the air filter (40) by the rotating brush (51).

Further, with the plate member (76) brought into contact with the plurality of longitudinal ribs (44) of the air filter (40), the pressing portions (72) corresponding to the longitudinal ribs (44), respectively, are no longer necessary unlike the first embodiment, thereby reducing the parts count. In addition, there is no need to attach the pressing portions (72) to be precisely aligned with the longitudinal ribs (44), thereby facilitating an assembly process, and reducing costs.

Second Embodiment

Figure 7:
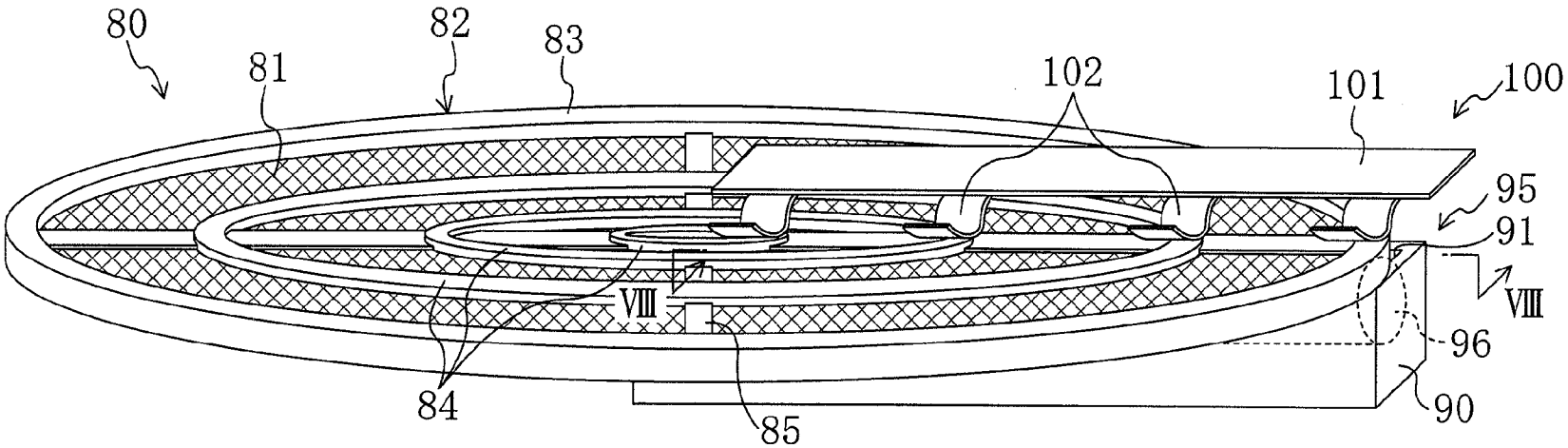
FIG. 7 is a perspective view schematically illustrating the neighborhood of an air filter of a second embodiment.
Figure 8:
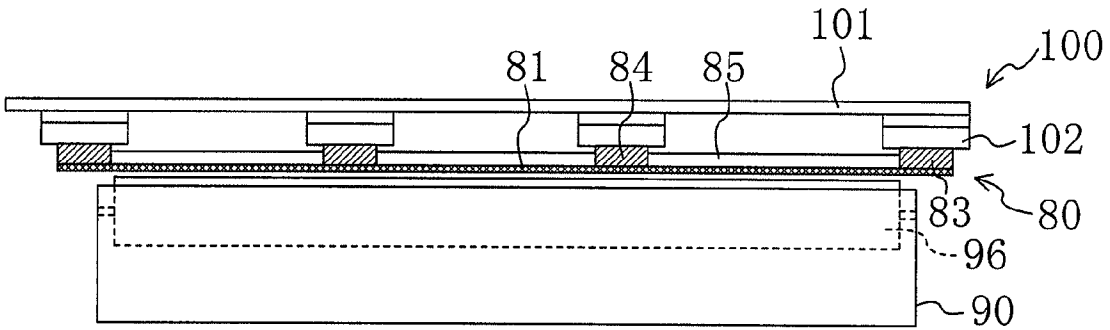
FIG. 8 is a cross-sectional view taken along the line VIII-VIII in FIG. 7.

A second embodiment of the present invention will be described with reference to FIGS. 7 and 8. The present embodiment is different from the first embodiment only in that an air filter (80) is substantially round when viewed in plan as shown in FIG. 7. Therefore, the same components will be designated by the same reference characters, and only the difference will be described below.

Specifically, as shown in FIG. 7, the air filter (80) includes a filter portion (81) which is substantially round when viewed in plan, and a frame (82) for holding the filter portion (81). The frame (82) includes an outer frame (83) which is substantially round when viewed in plan, and a plurality of (three in the example of FIG. 7) round ribs (84, 84, . . . ) which are substantially round when viewed in plan, and are coaxially arranged inside the outer frame (83), and a radial rib (85) extending in the shape of a cross when viewed in plan to connect the outer frame (83) and the round ribs (84) in the radial direction. The height of the radial rib (85) protruding upward (toward a filter presser described later) is the same as or smaller than the height of the round ribs (84) and the outer frame (83).

A dust container (90) is arranged below the air filter (80), and a filter presser (100) is arranged above the air filter (80) to correspond to the dust container (90), thereby sandwiching the air filter (80) therebetween in the vertical direction. Each of the dust container (90) and the filter presser (100) has a length substantially the same as the radius of the air filter (80), and is arranged in such a manner that one end thereof is close to the center of the air filter (80), and the other end is close to the outer circumference of the air filter (80).

In this embodiment, contrary to the first embodiment, the dust container (90) and the filter presser (100) are fixed to the casing body (26), and the air filter (80) rotates. Specifically, the air filter (80) is driven to rotate by an unshown motor which is arranged near the center or the outer circumference of the air filter, and the dust trapped on the air filter (80) is removed by a rotating brush (96) arranged in a brush receiving opening (91) of the dust container (90). Also in this embodiment, the rotating brush (96) constitutes a dust remover (95) for removing the dust trapped on the air filter (80).

In this embodiment, the dust container (90) and the filter presser (100) are fixed to the casing body (26), and the air filter (80) is configured to rotate. However, the structure is not limited thereto, and the air filter (80) may be fixed to the casing body (26), and the dust container (90) and the filter presser (100) may be configured to rotate.

In this embodiment, pressing portions (102) of the filter presser (100) above the air filter (80) are arranged to abut the round ribs (84) and the outer frame (83) of the air filter (80). Specifically, the pressing portions (102) corresponding to the round ribs (84) of the air filter (80) are attached to a support plate (101) extending in the radial direction of the air filter (80) to correspond to the dust container (90).

The rotating brush (96), the support plate (101), and the pressing portions (102) are configured in the same manner as those described in the first embodiment, and therefore, they will not be described in detail again.

Advantages of Second Embodiment

According to the present embodiment, the air filter (80) arranged on the suction side of the indoor fan (39) is round-shaped when viewed in plan, and the filter presser (100) and the dust container (90) are arranged to sandwich the air filter (80) therebetween in the vertical direction. Further, the round ribs (84) and the outer frame (83) of the air filter (80) are biased downward by the pressing portions (102) of the filter presser (100). Therefore, the filter portion (81) of the air filter (80) can be pressed against the rotating brush (96) arranged in the brush receiving opening (91) of the dust container (90), thereby allowing for efficient removal of the dust trapped on the filter portion (81) by the rotating brush (96).

Further, like the first embodiment, since the ribs (84) of the air filter (80) are pressed downward by the pressing portions (102) of the filter presser (100), the radial rib (85) can be provided on the air filter (80) without providing the filter presser (100) with a mechanism for preventing the interference with the ribs. This can increase the rigidity of the whole air filter (80). Thus, the filter portion (81) of the air filter (80) can more reliably be pressed against the rotating brush (96) by the filter presser (100). This allows for more reliable and efficient removal of the dust trapped on the filter portion (81) by the rotating brush (96).

Among the ribs (84, 85) of the air filter (80), the radial rib (85) has a height which is the same as or smaller than the height of the round ribs (84) and the outer frame (83) to which the pressing portions (102) of the filter presser (100) abut. Therefore, when the air filter (80) rotates while the pressing portions (102) abutting the round ribs (84), the interference of the pressing portions (102) with the radial rib (85) can reliably be prevented. This allows for smooth relative movement of the filter presser (100) and the air filter (80).

Other Embodiments

The above-described embodiments may be modified in the following manner

In the above-described embodiments, each of the pressing portions (72, 102) of the filter presser (70, 100) is made of a plate member which is bent into a downward convex shape at one end thereof to have a substantially semicircular cross section. However, the configuration of the pressing portion is not limited thereto, and any configuration may be employed as long as the pressing portion can press the ribs (44, 84) and the outer frame (43, 83) of the air filter (40, 80).

Specifically, each of the pressing portions may be made of a plate member bent in the shape of U, and both ends of the U-shaped plate member may be fixed to the support plate (71, 101) in such a manner that the bent portions of the pressing portions abut the ribs (44, 84) and the outer frame (43, 83) of the air filter (40, 80). With this configuration, the bent portions of the plate member can press the ribs (44, 84) and the outer frame (43, 83) of the air filter (40, 80) toward the rotating brush (51, 96). The plate member for realizing the above-described structure may be replaced with an elastic member such as rubber etc. Specifically, an elastic member may be formed substantially in the shape of D when viewed in section, and the elastic member may be attached to the support plate (71, 101) in such a manner that a convex portion thereof abuts the ribs (44, 84) and the outer frame (43, 83) of the air filter (40, 80).

The pressing portion may be formed by attaching a pressing member to the other end of a spring connected to the support plate (71, 101) at one end thereof. With this configuration, the pressing member can reliably be brought into contact with the ribs (44, 84) and the outer frame (43, 83) of the air filter (40, 80) by the spring. Thus, the filter portion (41, 81) can reliably be pressed against the rotating brush (51, 96).

In the above-described embodiments, the dust removed from the air filter (40, 80) is contained in the dust container (60, 90). However, in addition to the dust container (60, 90), a dust collection box of a larger capacity may be provided outside the casing (34). The provision of the dust collection box allows for reduction of frequency of dust collection. When the dust is transferred to the dust collection box, the dust may be transferred outside the casing (34) by the air blowing from the indoor fan (39), for example.

Figure 9:
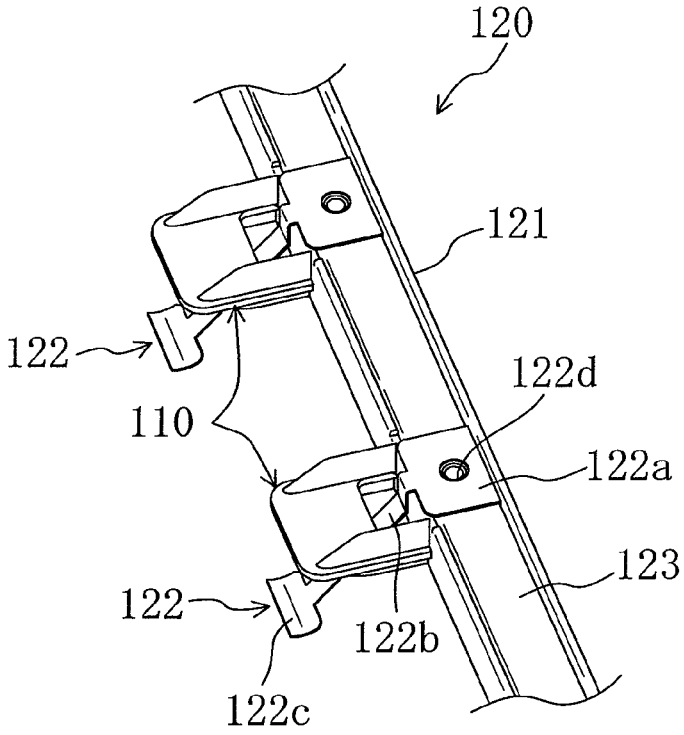
FIG. 9 is a perspective view illustrating the neighborhood of a pressing portion of an indoor unit according to the other embodiments.

In the above-described embodiments, an eaves portion (110) as a guard member may be arranged above the pressing portions (72, 102) of the filter presser (70, 100). Specifically, as shown in FIG. 9, plate-like eaves portions (110) may be provided above pressing portions (122) of a filter presser (120) to laterally protrude from a side face of a support member (121) so as to cover the pressing portions (122) from above. The eaves portion (110) is sized to substantially overlap with the pressing portion (122) when viewed from the top. Thus, the pressing portion (122) will not be touched by an operator from above, thereby preventing deformation of the pressing portion (122) as a spring member. In the example shown in FIG. 9, the pressing portion (122) includes a connector portion (122*a*) connected to the support member (121), a body (122*b*) extending obliquely downward from the connector portion (122*a*), and a contact portion (122*c*) at a distal end of the body (122*b*) to be in contact with the rib of the air filter. The connector portion (122*a*) is connected to an upper surface of the support member (121). Therefore, the eaves portion (110) is substantially in the shape of U when viewed in plan, thereby forming an insertion hole between the eaves portion (110) and the support member (121) through which a proximal end of the body (122*b*) can pass through. A plurality of reinforcement ribs are formed on an upper surface and a lower surface of the eaves portion (110). In FIG. 9, reference character 122*d* designates a volt hole, and reference character 123 designates a reinforcement for reinforcing the support member (121).

In the first embodiment, the filter presser (75) is constituted of the plate member (76) extending laterally across the air filter (40). The filter member of the second embodiment may also be constituted of the plate member.

INDUSTRIAL APPLICABILITY

As described above, the present invention is particularly useful for an indoor unit of an air conditioner including a grille portion on a suction side of an indoor fan.

DESCRIPTION OF REFERENCE CHARACTERS

10 Air conditioner
13 Indoor unit
26 Casing body
34 Casing
37 Indoor heat exchanger
39 Indoor fan
40, 80 Air filter
41 Filter portion
42, 82 Frame
43, 83 Outer frame
44 Longitudinal rib (first rib)
45 Lateral rib (second rib)
50, 95 Dust remover
51, 96 Rotating brush
60 Dust container
70, 75, 100, 120 Filter presser
72, 102, 122 Pressing portion
72*a* Bent portion
76 Plate member
76*b* Bent portion
84 Round rib (rib)
85 Radial rib
110 Eaves portion (guard member)

The invention claimed is:

1. An indoor unit of an air conditioner comprising:

a casing containing an indoor heat exchanger, an indoor fan for sucking air from the inside of a room, and blowing the air to the inside of the room, and an air filter arranged on a suction side of the indoor fan;

a dust remover for removing dust trapped on the air filter, the dust remover arranged upstream, in the direction of air flow, of the air filter; and a filter presser arranged downstream, in the direction of air flow, of the air filter and presses the air filter against the dust remover by pressing a frame of the air filter without directly pressing a filter portion of the air frame, wherein the frame of the air filter includes an outer frame, and a first rib arranged inside the outer frame to extend in the direction of movement of the air filter and the dust remover, the filter presser includes a support plate extending in a direction orthogonal to a direction in which the first rib of the air filter extends, and a pressing portion, the pressing portion is a flat plate member which is bent into a downward convex shape at one end and fixed to the supporting member at another end, and the bend end abuts the frame of the air filter, and the air filter is configured to move relative to the dust remover, and the filter presser.

2. An indoor unit of an air conditioner comprising:

a casing containing an indoor heat exchanger, an indoor fan for sucking air from the inside of a room, and blowing the air to the inside of the room, and an air filter arranged on a suction side of the indoor fan;

a dust remover for removing dust trapped on the air filter, the dust remover arranged upstream, in the direction of air flow, of the air filter; and a filter presser arranged downstream, in the direction of air flow, of the air filter and presses the air filter against the dust remover by pressing a frame of the air filter without directly pressing a filter portion of the air frame, wherein the frame of the air filter includes an outer frame, and a first rib arranged inside the outer frame to extend in the direction of movement of the air filter and the dust remover, the filter presser is constituted of a substantially rectangular plate member extending in a direction orthogonal to a direction in which the first rib of the air filter extends, one of the long sides of the plate member having a bent portion which is bent in the thickness direction and extends in the longitudinal direction of the plate member, and part of the plate member at an outer peripheral side is biased to be pressed against the frame of the air filter and the filter presser is configured to abut the first rib to press the air filter against the dust remover.

3. The indoor unit of the air conditioner of claim 1 or 2, wherein the frame of the air filter further includes a second rib intersecting with the first rib.

4. The indoor unit of the air conditioner of claim 3, wherein a height of the second rib protruding toward the filter presser is the same as or smaller than a height of the first rib.

5. The indoor unit of the air conditioner of claim 1 or 2, wherein a guard member is provided above the pressing portion to cover the pressing portion.

6. The indoor unit of the air conditioner of claim 1 or 2, wherein the air filter is substantially round when viewed in plan, and an outer frame and a rib of the frame of the air filter are also substantially round when viewed in plan, and the air filter is configured to rotate relative to the dust remover, and the filter presser.

* * * * *